US010215487B2

(12) United States Patent
Nemov

(10) Patent No.: US 10,215,487 B2
(45) Date of Patent: Feb. 26, 2019

(54) METHOD OF CONTROL OF THE NATURAL GAS LIQUEFACTION PROCESS

(71) Applicant: Sakhalin Energy Investment Company Ltd., Hamilton (BM)

(72) Inventor: Ivan Vladimirovich Nemov, Yuzhno-Sakhalinsk (RU)

(73) Assignee: SAKHALIN ENERGY INVESTMENT COMPANY LTD., Hamilton (BM)

( * ) Notice: Subject to any disclaimer, the term of this patent is extended or adjusted under 35 U.S.C. 154(b) by 0 days.

(21) Appl. No.: 15/970,956

(22) Filed: May 4, 2018

(65) Prior Publication Data

US 2018/0320958 A1 Nov. 8, 2018

(30) Foreign Application Priority Data

May 5, 2017 (RU) ..... 2017116094

(51) Int. Cl.
*F25J 1/00* (2006.01)
*F25J 1/02* (2006.01)

(52) U.S. Cl.
CPC ..... *F25J 1/0252* (2013.01); *F25J 1/0022* (2013.01); *F25J 1/0092* (2013.01); *F25J 1/025* (2013.01);
(Continued)

(58) Field of Classification Search
CPC ..... F25J 1/0022; F25J 1/0249; F25J 1/0092; F25J 1/0252; F25J 1/0254
See application file for complete search history.

(56) References Cited

U.S. PATENT DOCUMENTS 4,809,154 A 2/1989 Newton
6,553,772 B1 * 4/2003 Belanger ..... F25B 9/006 62/51.2
(Continued)

FOREIGN PATENT DOCUMENTS

EA 12809 B1 12/2009
EA 13357 B1 4/2010
(Continued)

OTHER PUBLICATIONS

Russian Search cited in corresponding Russian application RU 2017116094 (Russian and an English translation thereof).
(Continued)

*Primary Examiner* — John F Pettitt, III
(74) *Attorney, Agent, or Firm* — Ladas & Parry LLP

(57) ABSTRACT

The present invention relates to the control systems of the compression refrigerating machines, namely, to the methods of control of the natural gas liquefaction process to produce liquefied natural gas (LNG), and can be used for liquefaction and cooling of natural gas on the most major technological lines and LNG production plants, working on the mixed refrigerant (MR). The method of control of the natural gas liquefaction process on the mixed refrigerant-operating LNG production plant comprises a periodic measuring of the current parameters of the said process, and controlling composition of the mixed refrigerant entering the main cryogenic heat exchanger, in order to achieve the optimal process parameters. Carnot factor is used as an optimality criterion for parameters of the process. The mixed refrigerant composition is controlled by direct calculation on the basis of the current process parameters and equation of state (for example, Peng-Robinson equation of state) of the substance amount of the mixed refrigerant components required to obtain in the main cryogenic heat exchanger the temperature profile corresponding to the optimal process parameters,
(Continued)

Figure 1:
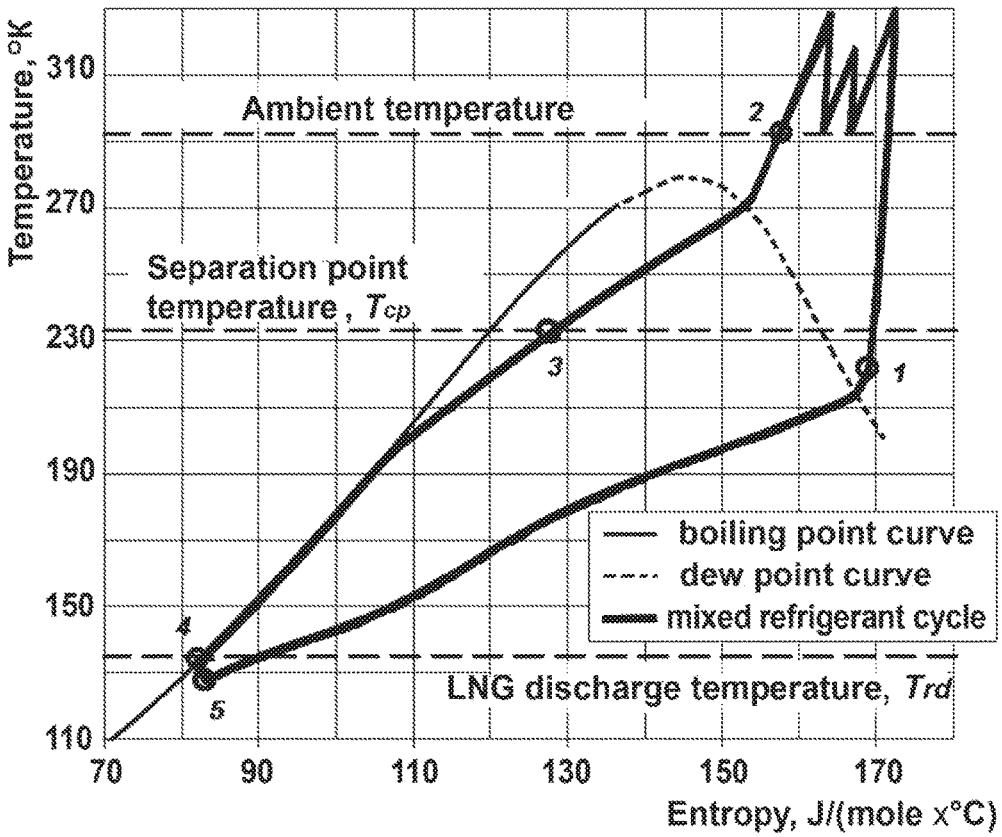

and to introduce the said components into the main cryogenic heat exchanger. The invention improves efficiency of the natural gas liquefaction process and, as a result, minimizes specific compressor power required for LNG production.

5 Claims, 2 Drawing Sheets

(52) U.S. Cl.
CPC ..... *F25J 1/0211* (2013.01); *F25J 1/0249* (2013.01); *F25J 1/0254* (2013.01); *F25J 2210/60* (2013.01); *F25J 2270/902* (2013.01); *F25J 2280/02* (2013.01); *F25J 2280/50* (2013.01)

(56) References Cited

U.S. PATENT DOCUMENTS

2013/0008204 A1* 1/2013 Kim ..... F25J 1/0012 62/600
2018/0209724 A1* 7/2018 Repasky ..... F25B 45/00

FOREIGN PATENT DOCUMENTS

RU 2 234 648 C2 8/2004
WO 2012/125018 A1 9/2012

OTHER PUBLICATIONS

Decision to grant a patent for an invention and (Russian and an English translation thereof).
RU 2 234 648 C2_Espacenet Abstract English Translation.

* cited by examiner

METHOD OF CONTROL OF THE NATURAL GAS LIQUEFACTION PROCESS

The present invention relates to the control systems of the compression refrigerating machines, namely, to the methods of control of the natural gas liquefaction process to produce liquefied natural gas (LNG), and can be used for liquefaction and cooling of natural gas on the most major technological lines and LNG production plants, working on the mixed refrigerant (MR).

An automated MR-operating LNG production control system is known from U.S. Pat. No. 4,809,154. Known system implements an algorithm, providing for three options of control: 1) in case the actual LNG production is below the scheduled production level, it should be increased by adding nitrogen or methane into mixed refrigerant circuit, taking into account temperature difference at the cold end of the main cryogenic heat exchanger (MCHE); 2) in case the actual LNG production is higher than the scheduled production level, it should be reduced by decreasing inlet pressure of the mixed refrigerant compressor; 3) in case the actual LNG production is equal to the scheduled production level, it should be optimized by maintaining the liquid mixed refrigerant stock in a predetermined range. In cases 1) and 2) the composition, amount of mixed refrigerant and the compression ratio of the compressor should be optimized in terms of overall efficiency. When LNG production occurs at the desired production rate, a process optimization procedure is initiated. It starts with validation of the mixed refrigerant level in a high pressure separator. If necessary, the excess amount of liquid mixed refrigerant is removed from the system, or vice versa, all components of the mixed refrigerant are added in proportion to their current content in the blend to obtain the desired level. Then the MR-related parameters are sequentially adjusted, namely, the flow rate of the mixed refrigerant heavy fraction, the nitrogen content in the mixed refrigerant, and the ethane to propane content ratio of the mixed refrigerant. At the same time, the algorithm tries to obtain the maximum efficiency, which is being calculated continuously as a ratio of cost of the produced LNG amount to the value of combustion heat of the fuel gas used for production of this LNG amount.

A shortcoming of the optimization and control algorithm implemented in the known system is that obtaining the optimal operation mode of the LNG production plant requires a long time and stable external conditions, namely, the ambient environment and the feed gas temperatures, scheduled production rate of the plant, and the scheduled LNG temperature at the exit of the main cryogenic heat exchanger. Since the steps are carried out sequentially rather than continuously, and there are several optimization criteria (liquid mixed refrigerant level in the high pressure separator, temperature difference at the cold end of the main cryogenic heat exchanger, and the ratio of cost of the produced LNG amount to the value of combustion heat of the fuel gas used for production of this LNG amount), the optimal mode can be obtained only after several iterations. An additional drawback is that a non-invariant efficiency criterion is used, which depends on external conditions.

A method closest by its technical essence to the present invention is disclosed in the international application WO 2012125018; this method of controlling the natural gas liquefaction process by means of a mixed refrigerant-operating plant comprises periodic measuring of current parameters of the said process and controlling the mixed refrigerant composition in the main cryogenic heat exchanger in order to achieve optimal parameters of the process. The essence of the method consists in use of the "control-by-instructions system" in form of a program code ensuring maintaining the scheduled main cryogenic heat exchanger temperature profile.

The drawbacks of the known method are insufficient accuracy and rate of the control in conditions of rapidly changing ambient temperature.

A technical problem solved by the present invention is the elimination of the said drawbacks and creation of a control method allowing for quick search of the optimal settings for certain MR components concentrations, as well as their accurate and stable control. Technical result consists in increasing efficiency of the natural gas liquefaction cycle and, consequently, minimizing specific power of the MR compressor required for LNG production.

The problem is solved, and the technical result is achieved with a method of control of the natural gas liquefaction process by means of a mixed refrigerant-operating plant, comprising a periodic measuring of the current parameters of the said process, and controlling composition of the mixed refrigerant entering the main cryogenic heat exchanger, in order to achieve the optimal process parameters; Carnot factor is used as an optimality criterion for parameters of the process, and the mixed refrigerant composition is controlled by direct calculation, on the basis of the current process parameters and equation of state, of the substance amount of the mixed refrigerant components required to achieve in the main cryogenic heat exchanger the temperature profile corresponding to the optimal process parameters, and introduction of the said components into the mixed refrigerant cycle in the calculated amount.

Preferably, as an equation of state the Peng-Robinson equation of state is used.

Figure 2:
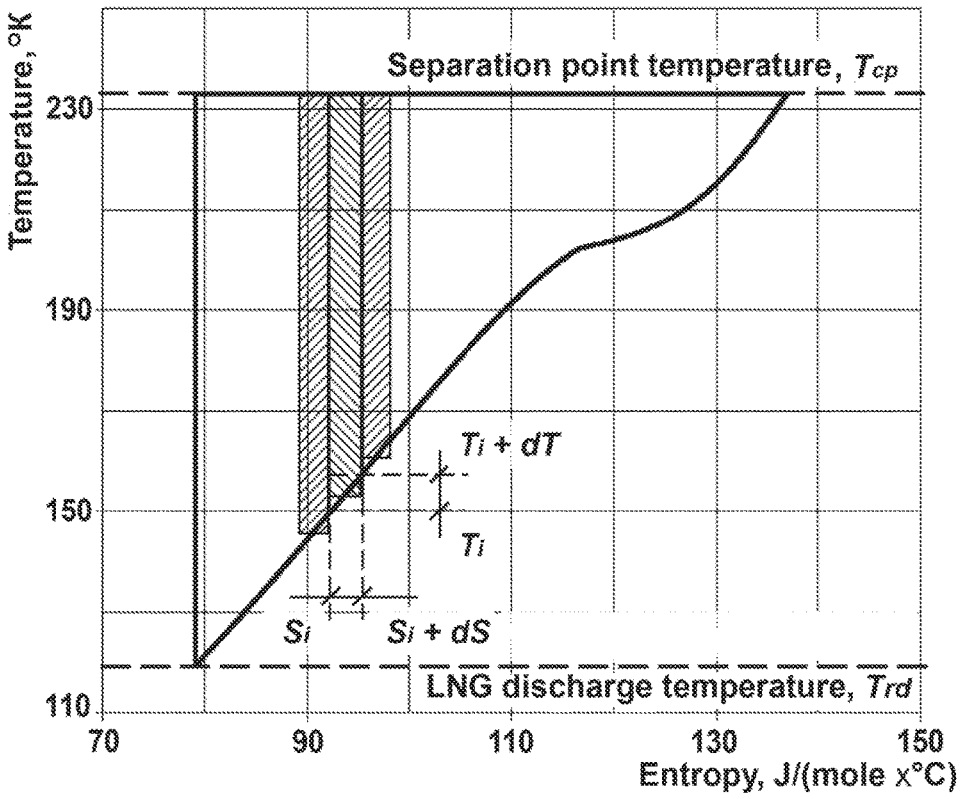

FIG. 1 shows a diagram of a real cooling cycle (1-2—compression with intercooling and aftercooling in air-cooling units; 2-3—cooling of the mixed refrigerant in the precooling mixed refrigerant cycle (PMRC); 3-4—self-cooling of the mixed refrigerant in the main cryogenic heat exchanger, 4-5—throttling (isoenthalpic expansion); 5-1 boiling of the mixed refrigerant in the main cryogenic heat exchanger; and FIG. 2 demonstrates the same for the Carnot ideal cooling cycle.

Accordingly to the present invention, a method of control of the natural gas liquefaction process on the mixed-refrigerant-operating LNG production plant comprises a periodic measuring of the current parameters of the said process, and controlling composition of the mixed refrigerant entering the main cryogenic heat exchanger, in order to achieve the optimal process parameters.

Statistical processing of operational data for the past service periods is the most common method adopted in the LNG industry to optimize the composition of the mixed refrigerant in operating plants. It gives reliable results if the data sampling is sufficiently representative to reflect variations in the mixed refrigerant composition and efficiency of the cycle. The method is based on extraction of the data with the maximum efficiency indicators from the overall data samples and establishing the relationships between the cooling temperature in the precooling mixed refrigerant cycle and the optimal concentrations of the mixed refrigerant components for the extracted data. The main complication of this method is the selection of an invariant cycle performance indicator that would be self-sufficient for characterizing its efficiency.

In the method according to the present invention, the invariant Carnot factor is used as a criterion of optimality of the process parameters. The invariance property of a parameter means that there is no correlation of the parameter with operating conditions (ambient temperature, LNG holding/offloading mode, etc.). This factor is used as a criterion for optimizing the liquefaction cycle on a mixed refrigerant. Optimization process is carried out in two steps. In the first step, a relationship is established between the liquefaction cycle efficiency and the temperature profile of the main cryogenic heat exchanger. It was experimentally confirmed that the effectiveness of the liquefaction cycle depends on the temperature approach in the main cryogenic heat exchanger. In the second step, a relationship is established between the optimal temperature profiles of the main cryogenic heat exchanger and the mixed refrigerant composition.

Calculation of the target concentrations of the mixed refrigerant components is performed on the basis of extracted data samples corresponding to the highest production rate (top 15% of the Carnot factor values from the overall data samples). Further, this extracted data samples are used for obtaining relationships between the natural gas temperature at the main cryogenic heat exchanger inlet and the optimal temperature approaches inside the main cryogenic heat exchanger on its warm and cold ends, and also in the middle of it. And finally, relationships between the natural gas temperature at the main cryogenic heat exchanger inlet and the optimal concentrations of the mixed refrigerant components are derived from operating data of the liquefaction process with the optimal temperature approaches inside the main cryogenic heat exchanger. The use of the invariant parameter as an optimization criterion improves calculation accuracy of the target concentrations. The advantage of using Carnot factor as an invariant parameter is realized from the fact that, on the one hand, its value does not depend on the operating conditions (production rate of the plant, ambient temperature, changing of LNG holding/offloading modes), and on the other hand, it characterizes the cooling cycle efficiency. Thus, comparison of operation efficiency can be performed in a wide range of operating conditions on a uniform scale basis.

In accordance with the basic physics laws, efficiency of the liquefaction cycle (expressed by the Carnot factor) depends on the temperature profile of the main cryogenic heat exchanger, which, in turn, depends on the mixed refrigerant composition. Following this cause-and-effect relationship while deriving relationships for the optimal concentrations of the mixed refrigerant components improves their accuracy. This is explained by the fact that the noise of the measuring instruments included in the Carnot factor calculation values does not affect the correlations for the optimal concentrations of the mixed refrigerant components, since relationships for the optimal temperature profile of the main cryogenic heat exchanger are used for their determination.

Accordingly to the invention, composition of the mixed refrigerant is controlled by directly calculating amounts of substance of the mixed refrigerant components (instead of directly using concentrations of the mixed refrigerant components in the mole percents), required for obtaining a temperature profile in the main cryogenic heat exchanger corresponding to the optimal process parameters. Both actual concentration values of the mixed refrigerant components and the settings for the target concentrations of the mixed refrigerant components are used to calculate the actual and target amounts of substance for each of the components in the closed system of the mixed refrigerant cycle. Parallel calculation of current and target amounts of substance of each of the components is carried out in a distributed control system for continuous and synchronized obtaining of the results. Data on the current process parameters from the pressure and temperature gauges placed throughout the whole mixed refrigerant cycle is shared for use while calculating the current and target amounts of substance of the mixed refrigerant components, and the calculation results are periodically updated at a fixed frequency. These calculations are based on knowledge of the internal volume of the mixed refrigerant cycle segments and evaluation of single-and-two-phase mixtures of the mixed refrigerant on the basis of the equation of state. As an equation of state, any known real gas equation of state applicable to light hydrocarbon mixtures, for instance, Peng-Robinson equation of state, can be used. The difference between the current and target values of amounts of substance of the mixed refrigerant components is controlled at zero set point by means of the control valves. The method according to the invention based on the calculated values of the amount of substance of each of the component in the closed system of the mixed refrigerant cycle allows to eliminate the correlation between the control loops of each of the components, i.e. automatic actions to control one mixed refrigerant component do not effect (or have just a little effect) on control of the other components. The absence of interaction between the control loops allows for accurate (with minimal difference between the controlled variable and its set point value) and stable (not influenced by the operating conditions) control of concentrations. Such approach to control the mixed refrigerant composition ensures closest approach of the mixed refrigerant components concentrations to their optimal values, allowing a plant to be operated with the maximum production rate.

After calculation, the mixed refrigerant components in the calculated amount are introduced into the main cryogenic heat exchanger. The mixed refrigerant cycle is equipped with make-up control valves used for adding any component to the system, as well as with drain and vent control valves, which allows for removing excessive amounts of liquid or vapor mixtures of the components from the system.

The method according to the present invention is implemented by performing the following sequence of actions:

1. On the basis of the recorded parameters for a sufficiently long operation period of an LNG production plant the Carnot factor is calculated by the formula given in the example below.

2. A mathematical function is determined of the relationship of the mixed refrigerant composition to the natural gas temperature at the cooling cycle inlet for operation periods with maximum Carnot factor values, calculated during the previous step.

3. By means of the mathematical relationship derived at the previous step, for the natural gas temperature at the cooling cycle inlet, the optimal concentration values of the mixed refrigerant components are calculated.

4. For the optimal concentration values of the mixed refrigerant components, obtained at the previous step, and for the current concentration values of the mixed refrigerant components, the target and current amounts of substance of the mixed refrigerant components are calculated by using the equation of state, as well as the difference between the target and current values of the amounts of substance is estimated.

5. Using control valves, the corresponding differences between the target and current values of the mixed refrigerant components obtained at the previous step are introduced into and/or removed from the mixed refrigerant circuit. To perform this step specially developed automatic control loops are used.

6. Steps 3 to 5 are performed periodically during the whole operation period of the LNG production plant at a frequency sufficient to maintain optimal concentration values of the mixed refrigerant components. Steps 1-2 are repeated in case of significant change of the operating mode of LNG production process (for example, after modification of the LNG production plant) after accumulation of sufficient data.

EXAMPLE

Application of the method according to the present invention for optimization of the mixed refrigerant composition at the "Prigorodnoye" LNG production plant is described below.

Assuming that the refrigerating capacity of the precooling mixed refrigerant cycle is a predetermined and constant value, total output of LNGs measured directly at the exit of the main cryogenic heat exchanger, will depend on:

- inlet natural gas temperature or so-called "cut-point temperature" $T_{cp}$ (determined by operating conditions of the precooling mixed refrigerant cycle);
- LNG temperature on outlet of the main cryogenic heat exchanger or so-called "LNG run-down temperature" Trd (maintained at its set point value by a separate independent control loop);
- available power of the mixed refrigerant compressor drivers;
- refrigeration efficiency of the mixed refrigerant cycle, determined as a ratio of refrigeration transferred to natural gas flow to total power of the compressors' drivers. This efficiency can vary depending on operating conditions of the mixed refrigerant cycle, as well as on equipment capacity.

Actual refrigeration efficiency of the mixed refrigerant cycle can be calculated by the formula:

$$COP_{act} = \frac{F_{LNG} \times \Delta H_{LNG}}{P_{MR}} \tag{1}$$

where:

$F_{LNG}$—LNG flow rate;

$\Delta H_{LNG}$—natural gas enthalpy change in the temperature range from $T_{cp}$ to $T_{rd}$;

$P_{MR}$—power of the mixed refrigerant compressors drivers.

Refrigeration efficiency of the mixed refrigerant cycle is invariant to available power changes, since LNG production rate is a function of power (1).

As a parameter, which is invariant not only to available power changes, but also to $T_{cp}$ and $T_{rd}$, a ratio of actual refrigeration efficiency to ideal refrigeration efficiency (Carnot factor) has been used:

$$\psi = \frac{COP_{act}}{COP_{id}} = \frac{F_{LNG} \times \Delta H_{LNG}}{P_{MR}} \times \frac{W_{id}}{\Delta H_{LNG}} = \frac{F_{LNG} \times W_{id}}{P_{MR}} \tag{2}$$

where $W_{id}$— minimal specific work per 1 kg of natural gas, required for its cooling from $T_{cp}$ to $T_{rd}$ in ideal cooling cycle conditions.

When determining an ideal cooling cycle for natural gas liquefaction (FIGS. 1, 2), a few assumptions were made:

- the ideal cycle can be represented as a sequence of Carnot cycles, each of which operates between a certain temperature of the refrigerator corresponding to the natural gas condensation curve, and the receiver temperature, which is the same for all the cycles;
- temperature of the receiver coincides with the natural gas temperature at the inlet of the mixed refrigerant cycle.

Minimal specific work of the ideal cycle can be determined proceeding from the basic provisions of the Carnot cycle:

$$dw_{id} = dq_{PMR} - dq_{NG} \tag{3}$$

$$dq_PMR = T_cp \times dS \tag{4}$$

$$dq_{NG} = T \cdot dS \tag{5}$$

where $dq_{PMR}$—an amount of heat withdrawn from the natural gas flow and transferred to the receiver, which is the precooling mixed refrigerant cycle;

dS—change of entropy corresponding to amount of heat $dq_{NG}$ withdrawn from the natural gas flow at the absolute temperature T.

$$dw_{id} = (T_{cp} - T)\frac{dq_{NG}}{T} = T_{cp}\frac{dq_{NG}}{T} - dq_{NG} \tag{6}$$

Condensation heat extracted from natural gas can be determined numerically, using simulation tools, and then converted to analytical form as a function of temperature:

$$dq_{NG} = \lambda(T) \cdot dT \tag{7}$$

where λ(T)—specific heat capacity of natural gas as a function of absolute temperature.

Finally, after integrating (6), minimal specific work $W_{id}$ can be expressed as a function of $T_{cp}$ and $T_{rd}$, and then used to calculate the Carnot factor (2):

$$W_{id} = \int dw_{id} = T_{cp} \cdot \int_{T_{cp}}^{T_{rd}} \frac{\lambda(T)}{T} \cdot dT - \int \frac{T_{rd}}{T_{cp}} \lambda(T) \cdot dT \tag{8}$$

The main advantage of Carnot factor is its invariance, which makes it possible to compare the mixed refrigerant cycle characteristics on a uniform scale basis, regardless of the precooling mixed refrigerant cycle achieved capacity, available power of the compressors drivers, and LNG run-down temperature variations. Thus, probability distribution of the Carnot factor for a year of the plant operation can help evaluate potential for increase of refrigeration cycle efficiency, and confirm a positive effect after implementation of changes related to optimization. Operational data over the past time periods, including an array of values of the Carnot factor, were processed with a number of operations:

- filtering to exclude data related to sensor failure, operation at minimum production rate or in unsteady mode, operation with equipment being in shut down state or under repair at the moment and affecting efficiency of the process;
- evaluating error in Carnot factor calculation, related to signal noise, as well as dispersion caused by plant operation in non-optimum conditions;

evaluating maximal possible increase of the mixed refrigerant cycle efficiency;

checking data for possible correlations between various technological parameters and the Carnot factor;

obtaining functions for optimal settings of the mixed refrigerant composition on the basis of operational data characterized by top performance;

checking functions obtained for the optimal MR composition set point values by applying them to the entire data sample with subsequent evaluation of the expected economic effect.

List of technological parameters checked for possible correlation with Carnot factor included temperature approaches between warm and cold flows in the main cryogenic heat exchanger, values of the mixed refrigerant overheat relative to the dew point at the outlet from the main cryogenic heat exchanger, mixed refrigerant compressor pressure ratio, light mixed refrigerant (LMR) to heavy mixed refrigerant (HMR) mass flow ratio, compositions of LMR and HMR and their derivatives, amounts of substance and concentrations of the mixed refrigerant components in the cycle, and various combinations of the above-mentioned parameters. Obvious correlations were revealed only between temperature approaches in the main cryogenic heat exchanger and the Carnot factor, and between concentrations of the mixed refrigerant components and the temperature approaches. This confirms a theoretical conclusion that efficiency of the mixed refrigerant cycle heavily depends on the temperature approaches inside the main cryogenic heat exchanger. At the same time, the data obtained from the real operating plant indicates that low temperature approaches do not always correspond to the maximum efficiency of the cycle, most likely, due to the limited heat-exchange surface and formation of a region with the minimal temperature approach, which results in decrease of the heat exchange process intensity. Moreover, it was found that quantities of the mixed refrigerant components in the cycle do not affect its efficiency as concentrations of the components do. That is why quantities of the components cannot be used in the mixed refrigerant composition control scheme as self-sufficient optimizable variables. In other words, one combination of quantities of the mixed refrigerant components corresponds to a wide range of the component concentrations, including both optimal and sub-optimal values.

Operational data was sliced for Tcp values with an interval of 1° C. Further, these data slices were processed to extract data with the highest Carnot factor values (the upper 15%) and corresponding temperature approaches in the main cryogenic heat exchanger. To derive optimal temperature approach functions their average values were used. Finally, functions of the optimal temperature approaches were used to select corresponding mixed refrigerant component concentrations and establish relationship between Tcp and optimal composition of the mixed refrigerant. Subsequently, these relationships are used for continuous calculation and update of set values of the mixed refrigerant components concentrations in the control system.

Results of the operational data statistical processing and the mixed refrigerant cycle efficiency define requirements to accuracy of the mixed refrigerant composition control, necessary for obtaining the desired production rate improvement. Standard deviations of the mixed refrigerant components concentrations corresponding to operation with the maximum efficiency, from derived functions of the mixed refrigerant optimal composition, were used as a reference while evaluating compliance with the control accuracy requirements. This is due to the fact that composition control accuracy should be at last the same or better than accuracy of relationship between the mixed refrigerant composition and the cycle efficiency. Maintaining concentrations of the mixed refrigerant components within the target ranges ±0.3% is complicated by the fact that the measured quantitative composition is constantly experiencing a disturbing effect of:

controlling of the LMR/HMR ratio by the control system;

fluctuations of efficiency of the precooling mixed refrigerant cycle, resulting in Tcp changes;

controlling of pressure at the mixed refrigerant compressor inlet by the control system;

variation of mixed refrigerant circulation flow rate;

possible changing of the mixed refrigerant composition due to leaks from the component supply control valves or from MCHE tubes to the shell side.

All these factors require stable control of the mixed refrigerant composition.

From the viewpoint of process controllability, the amount of each of the components of the mixed refrigerant is a more suitable variable for control than its concentration. Amounts of the mixed refrigerant components do not depend on changes of operating parameters ($T_{cp}$, LMR/HMR ratio, etc.), and are not affecting each other, which simplifies structure of the model from MIMO (multiple inputs multiple outputs) to MISO (multiple inputs single output).

Conversion of actual and target concentrations of the mixed refrigerant components into their actual and target amounts in the mixed refrigerant system implies introduction of the measured values of liquid level in a separator (where cooled and partially condensed mixed refrigerant is separated to LMR and HMR), and liquid level setting values. It results in indirect control of not only mixed refrigerant composition, but also of the liquid level in the separator. Due to the higher accuracy of the control with use of the mixed refrigerant components, temperature changes in the separator tank result in only slight pressure fluctuations. This eliminates the need of using an additional protective pressure control loop.

Control of the mixed refrigerant composition usually is carried out by using multi-variable predictive control methods. However, due to breaking of interactions between the control variables (i.e., static decoupling of the control variables), a base-layer PID-based control can be applied.

In spite of the fact that thermobaric conditions and volumes are known for most of the mixed refrigerant circuit sections, continuous real-time estimation of each of the mixed refrigerant components, accumulated in the mixed refrigerant circuit, is complicated by non-uniformity of the mixed refrigerant composition in various circuit sections, variable gas compressibility factor and fluid density, as well as by the presence of the two-phase mixtures in some of the mixed refrigerant circuit sections:

$$n_j = R \cdot \sum_{i=1}^{m} C_i^j \cdot \frac{P_i \cdot V_i}{Z_i \cdot T_i} \tag{9}$$

where $n_j$—amount of substance of component j in the mixture;

R—universal gas constant;

$C_i^j$— concentration of component j at the section i in the mixed refrigerant system;

P_i, Ti—pressure and temperature at the section i;

Vi—internal volume of equipment and tubes at the section i;

Zi—compressibility factor of real gas at the section i.

In such conditions, it is advisable to use the algorithm for equation of state, which makes it possible to continuously evaluate properties of a gas, a liquid or two-phase mixture in all sections of the mixed refrigerant circuit. In particular, Peng-Robinson equation of state algorithm was introduced into distributed control system in the form of a program resistant to abnormal technological conditions, such as rapidly changing parameters or the withdrawal of equipment from operation, as well as to abnormal sensor signals. Calculations of amounts of the components on the basis of known internal volumes of equipment and tubes made it possible to evaluate current and target values of components amounts in the mixed refrigerant circuit and use them to control the mixed refrigerant composition.

It was assumed that the temperature of the separator is the same for current and target conditions, since the temperature is a parameter external to the system, depending only on refrigerating capacity of the precooling mixed refrigerant cycle. As well as the temperature and composition of the two-phase mixture, pressure and the vapour phase fraction completely define equilibrium of the two phases. In particular case of separation of the mixed refrigerant for the purpose of controlling its composition, the vapour phase fraction can be used as a variable with set value, since it directly relates to the controlled LMR/HMR ratio. Then the pressure in the separator tank will be the adjusted variable, a value of which is changed by a separate algorithm to obtain a specified vapor phase fraction. That is why in the equation of state calculation, LMR/HMR ratio value is provided alongside with other current parameters of LNG production process, and MR separator pressure is adjusted in the calculation so as to obtain the set LMR/HMR ratio value. Calculation of the vapour-liquid equilibrium in the MR separator is synchronized in time for the actual and target compositions of the mixed refrigerant, which provides for simultaneous derivation of results of the vapour-liquid equilibrium calculation and correspondence of these results to the same parameters. It permits to minimize the sensor noise effect on calculation of the current and target quantities of the mixed refrigerant components.

Introduction of the mixed refrigerant composition control based on calculation of amounts of its components has yielded excellent results in terms of the correspondence of the current composition of the mixed refrigerant to the optimal target values. Analysis of operational data for a month period after introduction of the new control scheme demonstrated that the mixed refrigerant composition was maintained within the specified target range for approximately 98.5% of the control unit operating time, with specified range ±0.3 mole % in average. The average difference between the mixed refrigerant concentrations and the dynamically updated settings was minimized to zero, and a standard deviation of the control error decreased several times. At the same time, reliability of the proposed control method control allowed the system to operate autonomously without operator intervention. These results indicate that indirect control of the mixed refrigerant composition its composition by means of controlling amounts of its components can improve efficiency of an LNG plant operation.

The invention claimed is:

1. A method for control of a natural gas liquefaction process, wherein the process comprises (a) feeding a natural gas into a main heat exchanger through an inlet in the main heat exchanger; (b) feeding mixed refrigerant from a mixed refrigerant circuit into the main heat exchanger to cause the natural gas to undergo heat exchange with the mixed refrigerant so as to cool and liquefy the natural gas in the main heat exchanger; and (c) removing the liquefied natural gas through an outlet of the main heat exchanger, the method comprising the steps of:

(i) collecting data by measuring over a period of time a mixed refrigerant composition, a liquid natural gas (LNG) flow rate, power of a mixed refrigerant compressor driver, temperatures ($T_{cp}$) of the gas entering the inlet of the main heat exchanger and temperatures ($T_{rd}$) of the liquefied natural gas exiting the outlet of the main heat exchanger;

(ii) calculating a Carnot factor over a period of time based on the LNG flow rate, the power of the mixed refrigerant compressor driver and a minimal specific work that would be needed to liquefy the natural gas in an ideal cooling cycle as a function of $T_{cp}$ and $T_{rd}$ for the data collected in step (i);

(iii) determining a relationship of a composition of the mixed refrigerant fed into the main heat exchanger to the temperature ($T_{cp}$) of gas entering the inlet of the main heat exchanger based on samples of the data with a highest value of the Carnot factor;

(iv) calculating optimal concentration values of components of the mixed refrigerant fed into the main heat exchanger for the temperature ($T_{cp}$) based on the relationship determined in step (iii);

(v) calculating target amounts of the components of the mixed refrigerant in the mixed refrigerant circuit needed to obtain the optimal concentration values calculated in step (iv) using an equation of state and comparing the calculated target amounts with current amounts of components of the mixed refrigerant in the mixed refrigerant circuit to estimate a difference between the calculated target amounts and the current amounts; and (vi) adjusting the current amounts of the mixed refrigerant in the mixed refrigerant circuit using the difference estimated in step (v) to conform to the calculated target amounts.

2. The method according to claim 1, wherein the equation of state is the Peng-Robinson equation of state.

3. The method according to claim 1, further comprising repeating steps (iii) to (vi) periodically.

4. The method according to claim 1, further comprising repeating steps (i) to (ii) after a change in an operating mode of the natural gas liquefaction process.

5. The method according to claim 1, wherein the amounts of the mixed refrigerant components are adjusted with valves which control introduction into the mixed refrigerant circuit of individual components and removal from the mixed refrigerant circuit of a components mixture.

* * * * *